US009526391B2

(12) United States Patent
Lee et al.

(10) Patent No.: US 9,526,391 B2
(45) Date of Patent: Dec. 27, 2016

(54) CLEANING SYSTEM AND MAINTENANCE STATION THEREOF

(75) Inventors: Byoung In Lee, Suwon-si (KR); Dong Won Kim, Hwaseong-si (KR); Hyun Soo Jung, Seongnam-si (KR); Hwi Chan Jang, Yongin-si (KR)

(73) Assignee: SAMSUNG ELECTRONICS CO., LTD., Suwon-Si (KR)

( * ) Notice: Subject to any disclaimer, the term of this patent is extended or adjusted under 35 U.S.C. 154(b) by 1093 days.

(21) Appl. No.: 13/590,618

(22) Filed: Aug. 21, 2012

(65) Prior Publication Data

US 2013/0055521 A1 Mar. 7, 2013

Related U.S. Application Data

(60) Provisional application No. 61/530,019, filed on Sep. 1, 2011.

(30) Foreign Application Priority Data

Oct. 5, 2011 (KR) ..... 10-2011-0101417
Feb. 6, 2012 (KR) ..... 10-2012-0011834

(51) Int. Cl.
*A47L 5/38* (2006.01)
*A47L 11/40* (2006.01)
*A47L 11/33* (2006.01)

(52) U.S. Cl.
CPC ..... *A47L 11/4025* (2013.01); *A47L 11/33* (2013.01); *A47L 2201/00* (2013.01); *A47L 2201/024* (2013.01)

(58) Field of Classification Search
CPC A47L 11/33; A47L 11/4025; A47L 2201/024; A47L 2201/00
(Continued)

(56) References Cited

U.S. PATENT DOCUMENTS 1,706,039 A 3/1929 Owen
3,380,546 A 4/1968 Rabjohn
(Continued)

FOREIGN PATENT DOCUMENTS

CN 1284842 A 2/2001
CN 1454566 A 11/2003
(Continued)

OTHER PUBLICATIONS

European Search Report dated Jan. 16, 2015 issued in corresponding European Patent Application 14185173.3.
(Continued)

*Primary Examiner* — David Redding
(74) *Attorney, Agent, or Firm* — Staas & Halsey LLP

(57) ABSTRACT

A cleaning system includes a robot cleaner having an opening unit and a first dirt container funneled to the opening unit, and a maintenance station to which robot cleaner is docked to discharge dirt stored in the first dirt container. The maintenance station includes a first inlet hole configured to intake dirt from the first dirt container through the opening unit, a first outlet hole configured to blow air into the first dirt container, a circulating passage provided between the first inlet hole and the first outlet hole, a second dirt container disposed on the circulation passage to store dirt taken in from the robot cleaner, a draft apparatus having a draft fan and a fan motor to drive the draft fan to circulate air through the circulating passage, and a second outlet hole configured to discharge air inside the circulating passage of the maintenance station to an outside.

17 Claims, 15 Drawing Sheets

(58) Field of Classification Search
IPC ..... A47L 5/38
See application file for complete search history.

(56) References Cited

U.S. PATENT DOCUMENTS

| | | | |
|---|---|---|---|
| 3,827,103 | A | 8/1974 | Nordeen |
| 4,041,567 | A | 8/1977 | Burgoon |
| 4,513,472 | A | 4/1985 | Wells |
| 4,700,427 | A | 10/1987 | Knepper |
| 4,829,442 | A | 5/1989 | Kadonoff |
| 4,938,309 | A | 7/1990 | Emdy |
| 5,036,941 | A | 8/1991 | Denzin |
| 6,496,754 | B2 | 12/2002 | Song |
| 7,004,269 | B2 | 2/2006 | Song |
| 7,213,663 | B2 | 5/2007 | Kim |
| 7,296,643 | B2 | 11/2007 | Philipson |
| 7,660,650 | B2 | 2/2010 | Kawagoe |
| 7,721,829 | B2 | 5/2010 | Lee |
| 7,975,790 | B2 | 7/2011 | Kim |
| 8,092,272 | B2 | 1/2012 | Yang |
| 8,186,469 | B2 | 5/2012 | Vim |
| 8,774,970 | B2 | 7/2014 | Knopow |
| 8,950,038 | B2 | 2/2015 | Won |
| 2002/0104300 | A1 | 8/2002 | Hunt |
| 2003/0204923 | A1 | 11/2003 | Nakamura |
| 2004/0262060 | A1 | 12/2004 | Kim |
| 2005/0027396 | A1 | 2/2005 | Yang |
| 2005/0150519 | A1 | 7/2005 | Keppler et al. |
| 2005/0166355 | A1 | 8/2005 | Tani |
| 2006/0037170 | A1 | 2/2006 | Shimizu |
| 2006/0288519 | A1 | 12/2006 | Jaworski et al. |
| 2008/0235897 | A1 | 10/2008 | Kim et al. |
| 2010/0125968 | A1 | 5/2010 | Ho |
| 2010/0170057 | A1 | 7/2010 | Lee |
| 2010/0275405 | A1 | 11/2010 | Morse et al. |
| 2012/0181099 | A1 | 7/2012 | Moon |
| 2013/0056290 | A1 | 3/2013 | Lee |
| 2014/0145495 | A1 | 5/2014 | Shin |
| 2014/0152075 | A1 | 6/2014 | Kanatani |

FOREIGN PATENT DOCUMENTS

| | | | |
|---|---|---|---|
| CN | 201701156 | U | 1/2011 |
| DE | 10 2009 041 728 | A1 | 6/2010 |
| EP | 1 806 084 | A2 | 7/2007 |
| EP | 1 806 086 | A2 | 7/2007 |
| EP | 2 036 755 | A2 | 3/2009 |
| EP | 2 443 978 | A2 | 4/2012 |
| FR | 2 856 622 | A1 | 12/2004 |
| JP | 2007-181652 | A | 7/2007 |
| JP | 2009-82289 | | 4/2009 |
| JP | 2010-22657 | | 2/2010 |
| KR | 10-2004-0096253 | | 11/2004 |
| KR | 2007-0070658 | A | 7/2007 |
| KR | 10-0779193 | | 11/2007 |
| KR | 10-2010-0136882 | | 12/2010 |
| WO | 2007/137234 | A2 | 11/2007 |

OTHER PUBLICATIONS

European Search Report dated Feb. 22, 2013 in corresponding European Patent Application 12180884.4.
European Search Report dated Feb. 14, 2013 in corresponding European Patent Application 12180883.6.
U.S. Appl. No. 13/590,274, filed Aug. 21, 2012, Byoung In Lee, Samsung Electronics Co., Ltd.
Chinese Office Action issued Oct. 29, 2015 in corresponding Chinese Patent Application 20120319703.1.
Chinese Office Action issued Dec. 3, 2015 in corresponding Chinese Patent Application 201210320501.9.
U.S. Notice of Allowance mailed Sep. 14, 2015 in related U.S. Appl. No. 13/590,274.
U.S. Restriction Requirement mailed Jul. 14, 2015 in related U.S. Appl. No. 13/599,376.
U.S. Restriction Requirement mailed Mar. 18, 2015 in related U.S. Appl. No. 13/590,274.
U.S. Office Action mailed Dec. 24, 2015 in related U.S. Appl. No. 13/599,376.
European Search Report dated Nov. 22, 2012 issued in corresponding European Patent Application 12181180.6.
Final Office Action issued Jul. 20, 2016 in related U.S. Appl. No. 13/599,376 (21 pages).
Chinese Office Action dated Jul. 12, 2016 in corresponding Chinese Patent Application No. 201210319703.1.
Chinese Office Action dated Jul. 27, 2016 in corresponding Chinese Patent Application No. 201210320501.9.
U.S. Appl. No. 13/599,376, filed Aug. 24, 2012, Hyun Soo Jung, Samsung Electronics Co., Ltd.
Office Action issued Oct. 6, 2016 in co-pending U.S. Appl. No. 13/599,376 (14 pages).
European Office Action issued in Application No. 14185173.3-1712 dated Oct. 13, 2016 (4 pages).

CLEANING SYSTEM AND MAINTENANCE STATION THEREOF

CROSS-REFERENCE TO RELATED APPLICATIONS

This application claims the benefit of U.S. Provisional Patent Application No. 61/530,019, filed on Sep. 1, 2011 and Korean Patent Application Nos. 2011-0101417, filed on Oct. 5, 2011 and 2012-011834, filed on Feb. 6, 2012, in the Korean Intellectual Property Office, the disclosures of which are incorporated herein by reference.

BACKGROUND

1. Field

Embodiments of the present disclosure relate to a cleaning system using an autonomous navigation robot.

2. Description of the Related Art

An autonomous navigation robot is an apparatus configured to conduct a predetermined task while navigating a random area without a control of a user. The robot is capable of autonomous travelling for a considerable portion of the area, and such autonomous travelling may be embodied in various methods.

Particularly, a robot cleaner robot cleaner is an apparatus configured to clean dirt on a floor while navigating around a cleaning area without a control of a user.

In general, the robot cleaner robot cleaner forms a single cleaning system together with a maintenance station that is positioned at a particular place of an interior for recharging the robot cleaner or emptying dirt stored in the robot cleaner.

A maintenance station is provided with an inlet configured to intake dirt from a robot cleaner and a draft fan along with a fan motor configured to generate an intake force at the inlet. The air ventilated by the draft fan and the fan motor is discharged to an outside through an outlet or supplied to a direction of a dirt container of the robot cleaner through a circulation passage to be utilized in scattering the dirt inside the dirt container.

If a malfunction of the fan motor occurs or an operation time of the fan motor is extended during an operation of the maintenance station, the temperature around the fan motor is continuously increased and may damage a surrounding component of the fan motor. In addition, in a case that the temperature of the air is increased by the fan motor and the air heated circulates an inside of the robot cleaner and the maintenance station, the component inside the robot cleaner or the structure of the robot cleaner may be deformed.

SUMMARY

Therefore, it is an aspect of the present disclosure to provide a cleaning system and a maintenance station capable of improving a cleaning performance.

It is another aspect of the present disclosure to provide a cleaning system and a maintenance station capable of automatically discharging dirt of a robot cleaner.

It is another aspect of the present disclosure to provide a cleaning system capable of improving durability of a product by preventing a temperature increase by a fan motor.

Additional aspects of the disclosure will be set forth in part in the description which follows and, in part, will be apparent from the description, or may be learned by practice of the disclosure.

In accordance with one aspect of the present disclosure, a cleaning system includes a robot cleaner and a maintenance station. The robot cleaner has an opening unit and a first dirt container funneled to the opening unit. The maintenance station allows the robot cleaner to be docked thereto to discharge dirt stored in the first dirt container. The maintenance station includes a first inlet hole, a first outlet hole, a circulating passage, a second dirt container, a draft apparatus and a second outlet hole. The first inlet hole is configured to intake dirt from the first dirt container through the opening unit. The first outlet hole is configured to blow air into the first dirt container. The circulating passage is provided between the first inlet hole and the first outlet hole. The second dirt container is disposed on the circulation passage to store dirt taken in from the robot cleaner. The draft apparatus includes a draft fan and a fan motor to drive the draft fan and allows air to flow through the circulating passage. The second outlet hole is configured to discharge air inside the circulating passage of the maintenance station to an outside.

The circulating passage includes a first outlet passage connecting the draft apparatus to the first outlet hole, and the second outlet hole is connected to the first outlet passage such that some of air at the first outlet passage is discharged to an outside.

The maintenance station further includes a second outlet passage configured to connect the first outlet passage to the second outlet hole.

The first inlet hole is disposed to intake outside air to an inside of the maintenance station even in a state that the robot cleaner is docked to the maintenance station.

The cleaning system further includes a second inlet hole separately disposed from the first inlet hole and configured for outside air to flow into an inside the maintenance station.

In accordance with another aspect of the present disclosure, a cleaning system includes a robot cleaner and a maintenance station. The robot cleaner has an opening unit and a first dirt container funneled to the opening unit. The maintenance station allows the robot cleaner to be docked thereto to discharge dirt stored in the first dirt container. The maintenance station includes a first inlet hole, a first outlet hole, a circulating passage, a second dirt container, a draft apparatus, a second inlet hole and an outside air introducing passage. The first inlet hole is configured to intake dirt from the first dirt container through the opening unit. The first outlet hole is configured to blow air into the first dirt container. The circulating passage is provided between the first inlet hole and the first outlet hole. The second dirt container is disposed on the circulation passage to store dirt taken in from the robot cleaner. The draft apparatus includes a draft fan and a fan motor to drive the draft fan and allows air to flow through the circulating passage. The second inlet hole is configured to intake outside air to an inside the maintenance station. The outside air introducing passage is provided between the second inlet hole and the circulating passage to guide air introduced through the second inlet hole to the circulating passage.

The circulating passage includes a connecting passage configured to connect the second dirt container to the draft apparatus. The outside air introducing passage is funneled to the connecting passage.

The circulating passage includes an inlet passage provided between the first inlet hole and the second dirt container. The outside air introducing passage is funneled to the inlet passage.

The outside air introducing passage is directly funneled to the second dirt container.

The outside air introducing passage is funneled between the fan motor of the inlet passage and the dirt container.

The circulating passage includes a first outlet passage configured to connect the draft apparatus to the first outlet hole. The maintenance station further includes a second outlet hole configured to discharge air in the maintenance station to an outside and a second outlet passage configured to connect the first outlet passage to the second outlet hole.

The maintenance station further includes a filter disposed at the first outlet passage to remove dirt from air passed through the draft apparatus. Some of air passed through the filter is discharged to an outside the maintenance station through the second outlet passage.

The fan motor is disposed at an inside of the circulating passage.

In accordance with another aspect of the present disclosure, a cleaning system includes a robot cleaner and a maintenance station. The robot cleaner has an opening unit and a first dirt container funneled to the opening unit. The maintenance station allows the robot cleaner to be docked thereto to discharge dirt stored in the first dirt container. The maintenance station includes a first inlet hole, a first outlet hole, a circulating passage, a second dirt container, a draft apparatus, a second inlet hole, a second outlet hole and a cooling passage. The first inlet hole is configured to intake dirt from the first dirt container through the opening unit. The first outlet hole is configured to blow air into the first dirt container. The circulating passage is provided between the first inlet hole and the first outlet hole. The second dirt container is disposed on the circulating passage to store dirt taken in from the robot cleaner. The draft apparatus includes a draft fan configured for air to flow through the circulating passage and a fan motor configured to drive the draft fan. The second inlet hole is configured for outside air to flow into an inside of the maintenance station. The second outlet hole is configured to discharge air to an outside of the maintenance station. The cooling passage is formed between the second inlet hole and the second outlet hole to cool the fan motor of the draft apparatus.

The circulating passage and the cooling passage are disposed in an isolated manner from each other.

The fan motor is disposed at an inside of the cooling passage.

The maintenance station further includes a cooling purpose draft fan provided to generate an air flow at an inside of the cooling passage.

The maintenance station further includes a radiator disposed to receive heat from the fan motor.

The radiator is disposed at an inside of the cooling passage.

In accordance with another aspect of the present disclosure, a cleaning system includes a robot cleaner and a maintenance station. The robot cleaner has an opening unit and a first dirt container funneled to the opening unit. The maintenance station allows the robot cleaner to be docked thereto to discharge dirt stored in the first dirt container. The maintenance station includes a first inlet hole, a first outlet hole, a circulating passage, a second dirt container, a draft apparatus and a radiator. The first inlet hole is configured to intake dirt from the first dirt container through the opening unit. The first outlet hole is configured to blow air into the first dirt container. The circulating passage is provided between the first inlet hole and the first outlet hole. The second dirt container is disposed on the circulating passage to store dirt taken in from the robot cleaner. The draft apparatus includes a draft fan configured for air to flow through the circulating passage and a fan motor configured to drive the draft fan. The radiator is disposed to receive heat from the fan motor so that the fan motor is cooled.

At least one portion of the radiator is disposed at an outside of the maintenance station.

The cleaning system further includes a cooling purpose draft fan installed to generate an air flow that passes through the radiator.

The radiator is disposed at an inside of the maintenance station, and the maintenance station further includes a second inlet hole configured to introduce outside air to the maintenance station and a cooling passage configured to guide air introduced through the second inlet hole toward a direction of the radiator.

In accordance with another aspect of the present disclosure, a maintenance station to which a robot cleaner having a first dirt container is docked includes a first inlet hole, an air passage, a second dirt container, a draft apparatus, a first outlet hole and a second outlet hole. The first inlet hole is configured to intake dirt from the first dirt container of the robot cleaner. The air passage is connected to the first inlet hole to guide airflow. The second dirt container is disposed on the air passage to store dirt taken in from the robot cleaner. The draft apparatus includes a draft motor and a fan motor configured to drive the draft fan, and is configured for air to flow through the air passage. The first outlet hole is configured to discharge air guided through the air passage to an outside of the maintenance station. The second outlet hole is isolated from the first outlet hole to discharge air through a different passage other than through the first outlet hole.

The air passage includes a first outlet passage configured to connect the draft apparatus to the first outlet hole. The maintenance station further includes a second outlet passage configured to connect the first outlet passage to the second outlet hole such that some of the air passing through the first outlet passage is discharged through the second outlet hole.

The first outlet hole is disposed to blow air to an inside of the first dirt container of the robot cleaner.

The maintenance station further includes a second inlet hole provided in an isolated manner with respect to the first inlet hole and formed to introduce outside air to an inside of the maintenance station.

The second outlet hole is configured to be open and closed.

As described above, in accordance with the embodiment of the present disclosure, a large increase of the temperature of a maintenance station or a robot cleaner caused by a fan motor may be prevented, thereby improving durability of a product.

In addition, the dirt of a robot cleaner robot cleaner may be automatically discharged, thereby increasing a cleaning performance.

BRIEF DESCRIPTION OF THE DRAWINGS

These and/or other aspects of the invention will become apparent and more readily appreciated from the following description of the embodiments, taken in conjunction with the accompanying drawings of which.

DETAILED DESCRIPTION

Figure 1:
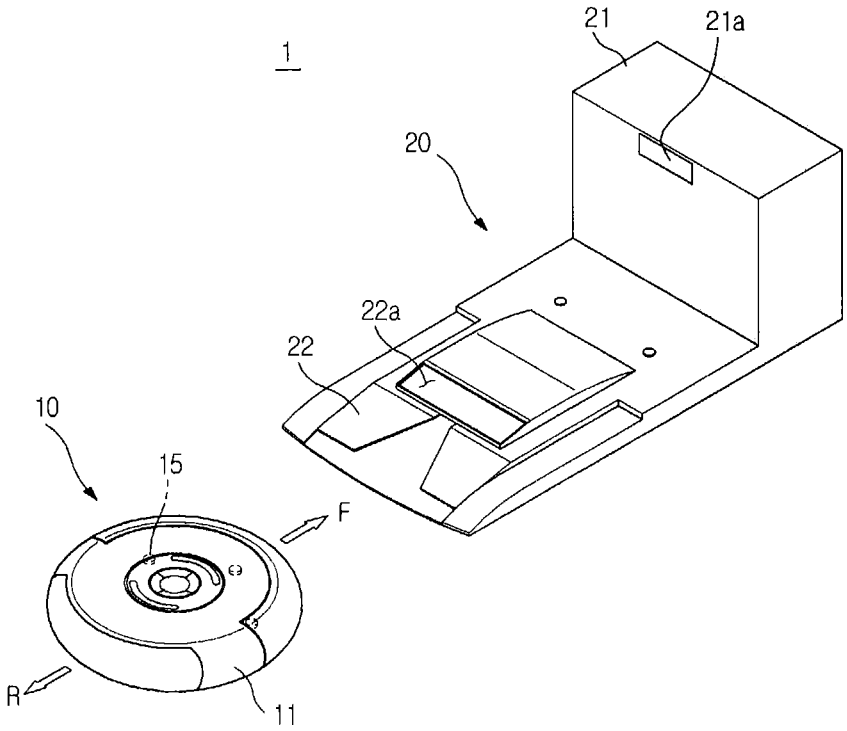
FIG. 1 is a view schematically illustrating a cleaning system in accordance with an embodiment of the present disclosure.

Reference will now be made in detail to the embodiments of the present invention, examples of which are illustrated in the accompanying drawings, wherein like reference numerals refer to like elements throughout.

Figure 2:
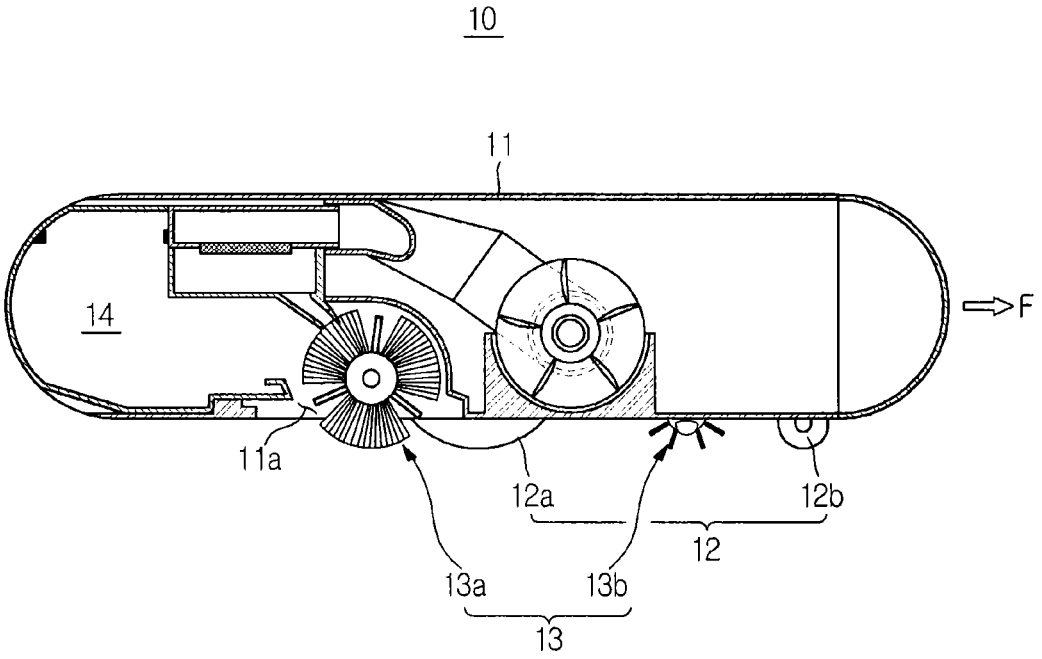
FIG. 2 is a cross-sectional view schematically illustrating a robot cleaner in accordance with the embodiment of the present disclosure.

Referring to FIGS. 1 to 2, a cleaning system 1 includes a robot cleaner 10 and a maintenance station 20.

The robot cleaner 1 may be docked into the maintenance station 20 in various situations, for example, in a case of charging a battery of the robot cleaner 10, in a case of the robot cleaner 10 completing a cleaning, or in a case of a dirt container 14 having a full of dirt, in a case of a user directly placing the robot cleaner 10 into the maintenance station 20, etc.

The robot cleaner 10 is provided with a body 11, a driving apparatus 12, a cleaning apparatus 13, various sensors 15, and a control apparatus (not shown).

The body 11 may come in various shapes, and as an example, the body 11 may be formed in a circular shape. The body 11 having a circular shape, even in a case when rotating, is configured to have a constant rotational radius, thereby avoiding contact with surrounding obstacles, and easily changing a direction.

The driving unit 12 includes left side and right side driving wheels 12*a* and a caster 12*b* configured for the body 11 to drive a cleaning area.

The left side and the right side driving wheels 12*a* is installed at a bottom center of the body 11, and the caster 12*b* is installed toward a front of a bottom of the body 11 for the robot cleaner 10 to have a stable stance.

The cleaning apparatus 13 is configured to clean a bottom and surroundings of the body 11, and is provided with a brush unit 13*a*, a side brush 13*b*, and a first dirt container 14 included therein.

The brush unit 13*a* is rotatably installed at a first opening unit 11*a* formed at a lower portion of the body 11, and is capable of collecting dirt on a floor into the first dirt container 14 by sweeping.

The side brush 13*b* is rotatably installed at one side of an edge of a lower portion of the body 11 and is capable of moving dirt collected at surroundings of the body 11 toward the brush unit 13*a*. The dirt moved toward the side brush 13*b*, as explained previously, is stored in the first dirt container 14 through the first opening unit 11*a*.

The first dirt container 14 is provided at an inside of the body 11 to store the dirt introduced through the first opening unit 11*a*.

Figure 3:
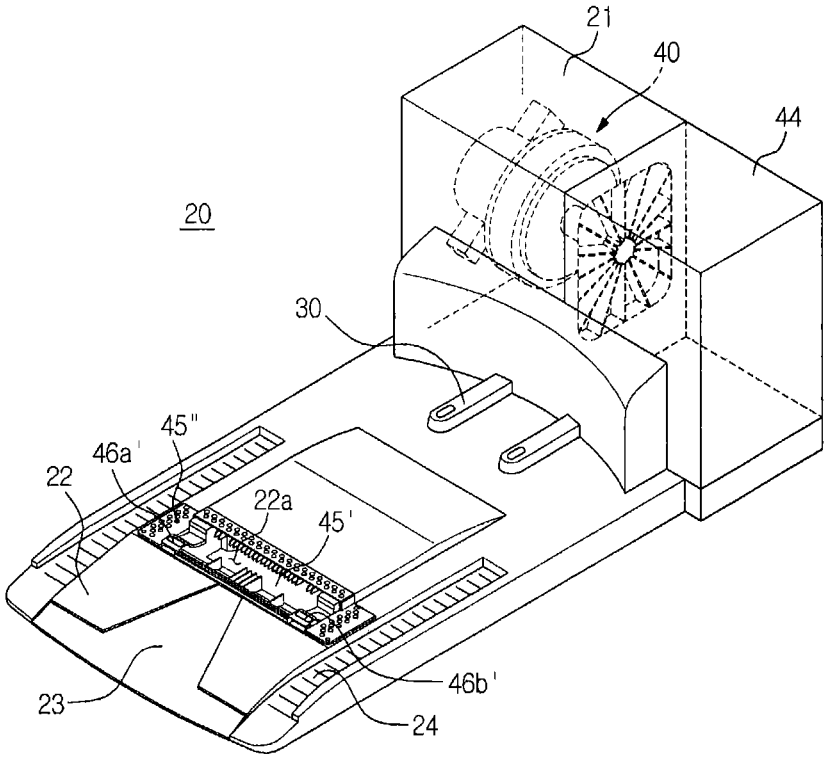
FIG. 3 is a view illustrating a maintenance station in accordance with the embodiment of the present disclosure.
Figure 4:
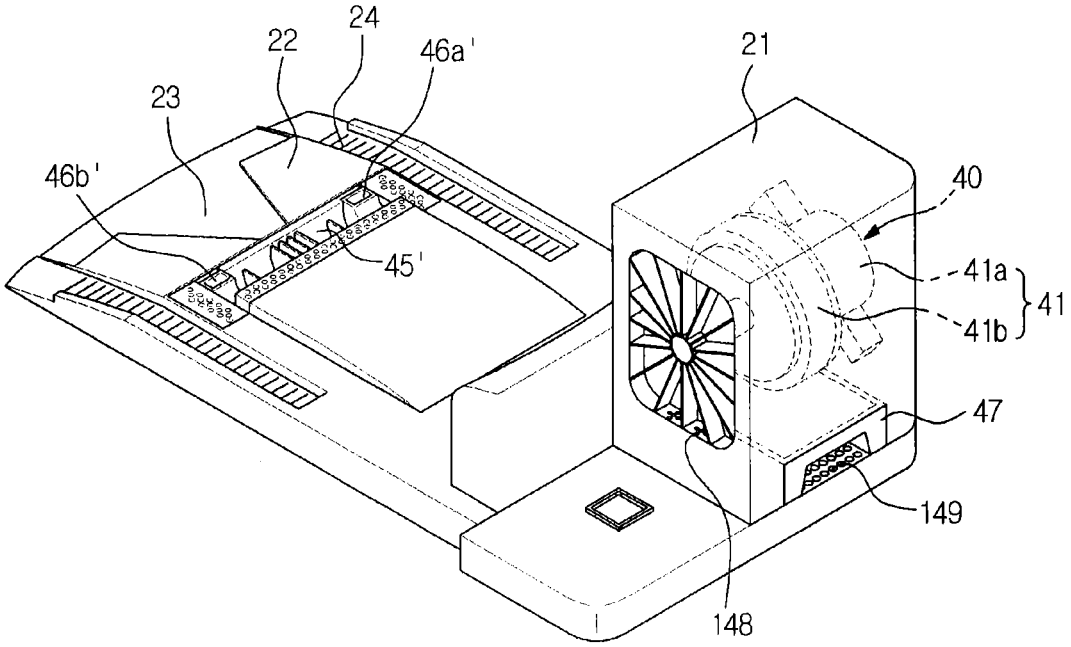
FIG. 4 is a perspective view illustrating the maintenance station in accordance with the embodiment of the present disclosure.

Referring to FIGS. 3 to 4, the maintenance station 20 is provided with a housing 21, a charging apparatus 30, a dirt eliminating apparatus 40, and a control unit (not shown) included therein.

A platform 22 is provided at the housing 21 to support the robot cleaner 10 when the robot cleaner 10 is docked into the maintenance station 20.

The platform 22 is provided in an inclined manner for the robot cleaner 10 to easily climb up and down on the platform 22. A caster guide unit 23 configured to guide the caster 12*b* of the robot cleaner 10 is formed on the platform 22, and a driving wheel guide unit 24 configured to guide the left side and right side driving wheels 12*a* may be formed on the platform 22.

A second opening unit 22*a* may be formed on the platform 22. The second opening unit 22*a* is provided at a position that corresponds to and enables funneling to the first opening unit 11*a*.

Therefore, the dirt discharged through the first opening unit 11*a* of the robot cleaner 10 is introduced to the second opening unit 22*a* of the platform 22, and is stored at a second dirt container 44, which is to be described later, of the maintenance station 20.

The second dirt container 44 provided at an inside the housing 21 of the maintenance station 20 is different from the first dirt container 14 of the robot cleaner 10 in that the second dirt container 44 is configured to store the dirt discharged from the first dirt container 14 of the robot cleaner 10.

Accordingly, the second dirt container 44 is formed to be larger than the first dirt container 14.

A docking guide apparatus 21*a* installed at an upper portion of the housing 21 is provided with a plurality of sensors included therein, and is capable of guiding the robot cleaner 10 to be accurately docked into the maintenance station 20 (refer to FIG. 1).

The charging unit 30 is installed at the platform 22, and is provided with a plurality of connecting terminals included therein.

The dirt eliminating apparatus 40 installed at the housing 21 is configured to constantly maintain a cleaning performance of the robot cleaner 10 by emptying the dirt stored at the first dirt container 14 of the robot cleaner 10 into the second dirt container 44 of the maintenance station 20.

The dirt eliminating apparatus 40 is provided with a draft apparatus 41 and an inlet duct 45, and an outlet duct 46 included therein.

The dirt eliminating apparatus 40 is an apparatus capable of having the air flow discharged from the outlet duct 46 to be taken again into the inlet duct 45 and eliminating the dirt stored at the first dirt container 14 of the robot cleaner 10 by using such circumfluence.

The draft apparatus 41 is an apparatus configured to intake or discharge air, and may be provided with a draft fan 41*b* and a fan motor 41*a* included therein.

The inlet duct 45 may be installed at an air inlet direction of the draft apparatus 41, and the outlet duct 46 may be installed at an air discharging direction of the draft apparatus 41.

At this time, the outlet duct 46 includes a first outlet duct 46*a* and a second outlet duct 46*b*.

An inlet port 45' of the inlet duct 45 may be formed as a part of the second opening unit 22*a*, and includes a first inlet port 45' and a second inlet port 45" which are formed as the inlet duct 45 is dispersed.

Since the first inlet port 45' and the second inlet port 45" are funneled to the inlet duct 45, the air or dirt introduced to the first inlet port 45' or the scattered air or dirt introduced to the second inlet port 45" flows toward a direction of the inlet duct 45, and afterwards is stored at the second dirt container 44 of the maintenance station 20 through the inlet duct 45.

The air discharged through the first outlet port 46*a*' and the second outlet port 46*b*", and through a second outlet port 46*a*' is moved toward an inner side of the first dirt container 14 to scatter the dirt inside the first dirt container 14 toward an outside, thereby enabling the scattered dirt to be taken in toward a direction of the first inlet port 45' and the second inlet port 45".

A brief explanation on the motion of the cleaning system 1 provided as such is as follows.

When the robot cleaner 10 is docked into the maintenance station 20, the first opening unit 11*a* of the robot cleaner 10 and the first opening unit 22*a* of the maintenance station 20 are funneled to each other.

The first inlet port 45' and the second inlet port 45" of the inlet duct 45 may be provided at an adjacent position to the first opening unit 11*a* of the robot cleaner 10, and may be disposed along the longitudinal direction of the first opening unit 11*a* of the robot cleaner 10.

In addition, the first outlet port 46*a*' and the second outlet port 46*b*' of the outlet duct 46 may also be disposed at an end portion of the longitudinal direction of the first opening unit 11*a* or at an adjacent position to the first opening unit 11*a* of the robot cleaner 10, that is, at a side portion of the robot cleaner 10.

The cross-sectional areas of the first inlet port 45' and the second inlet port 45" of the inlet duct 45 may be formed larger than those of the first outlet port 46*a*' and the second outlet port 46*b*' of the outlet duct 46. Desirably, the ratio of the cross-sectional areas of the first inlet port 45' and the second inlet port 45" and the first outlet port 46*a*' and the second outlet port 46*b*' may be established at about 7.5:1.

Since the amount of the inlet flow and the outlet flow of the draft apparatus 41 are about same, the air flow speed at the first outlet port 46*a*' and the second outlet port 46*b*' of the outlet duct 46 may be formed faster than that at the first inlet port 45' and the second inlet port 45" of the inlet duct 45 due to the cross-sectional difference of each port.

Therefore, the air which is escaped from the first outlet port 46*a*' and the second outlet port 46*b*' by the air flow speed difference as described above may be prevented from being directly taken into the first inlet port 45' and the second inlet port 45".

The air escaped from the first outlet port 46*a*' and the second outlet port 46*b*' may be dispersed to an inside the first dirt container 14 without being taken into a direction of the first inlet port 45' and the second inlet port 45". The air dispersed into the inside the first dirt container 14, after circulating at the inside the first dirt container 14, may flow to an outside the first dirt container 14, and afterwards be introduced to the first inlet port 45' and the second inlet port 45".

According to such structure, the air circulating or circumfluent by the dirt eliminating apparatus 40 of the maintenance station 20 at the time of a docking may form a single closed loop.

The air discharged from the draft apparatus 41 exits the first outlet port 46*a*' and the second outlet port 46*b*' of the outlet duct 46 at a fast speed and is introduced to the first dirt container 14 after passing through the side area of the first opening unit 11*a* of the robot cleaner 10. The air introduced to the first dirt container 14 is discharged to a central area of the first opening unit 11*a* of the robot cleaner 10, and is taken in again to the draft apparatus 41 after being introduced to the second dirt container 44 of the maintenance station 20 through the first inlet port 45' and the second inlet port 45" of the inlet duct 45.

In a process of the dirt eliminating apparatus 40 of the maintenance station 20 taking in the dirt from the first dirt container 14 of the robot cleaner 10, the temperature of the air circulating at an inside the housing 21 of the maintenance station 20 may be increased by the heat generated from the draft apparatus 41 installed at the maintenance station 20. Such temperature increase may affect the component inside the cleaning system to be deformed or damaged.

Figure 5:
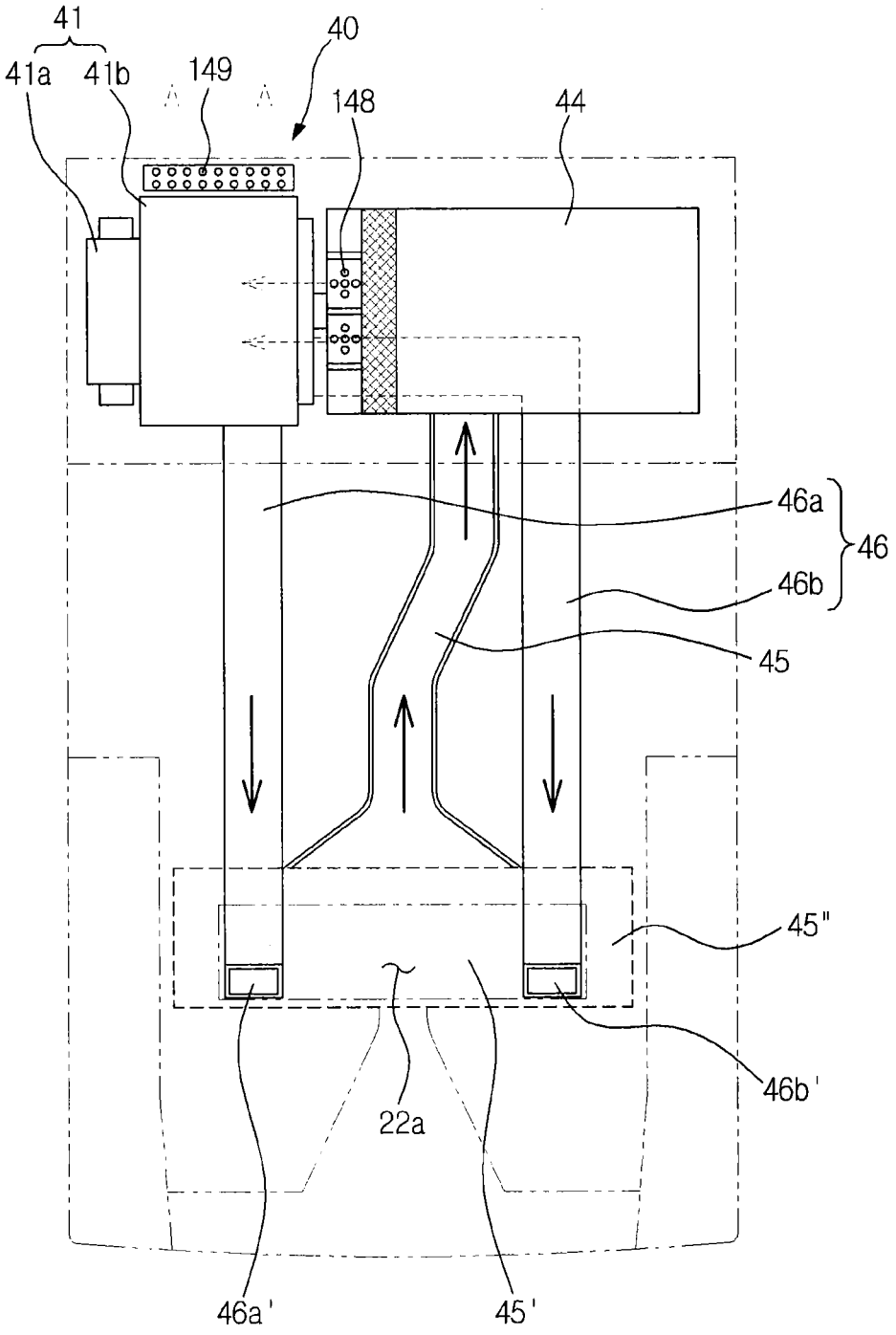
FIG. 5 is a view schematically illustrating a duct of the maintenance station in accordance with the embodiment of the present disclosure.
Figure 6:
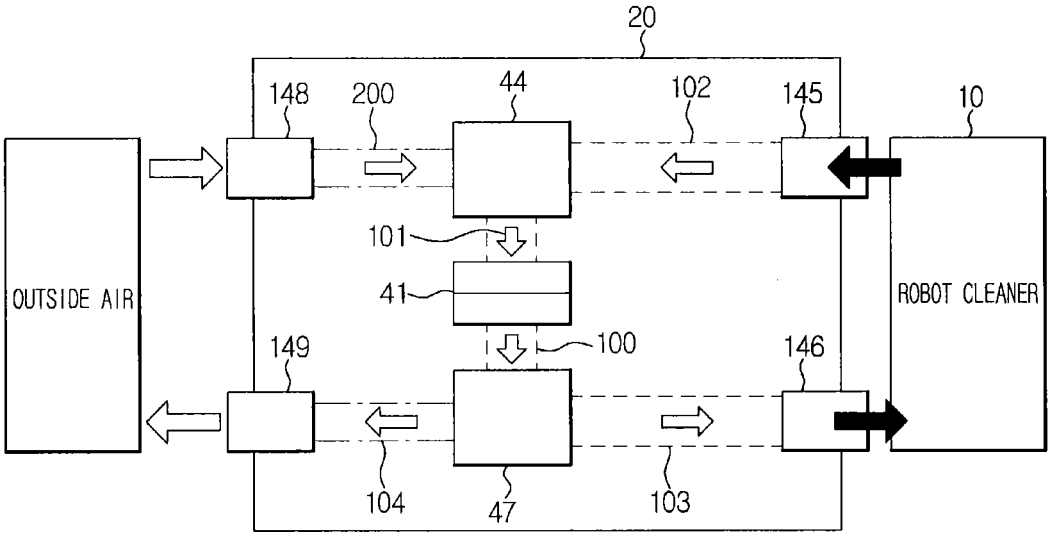
FIG. 6 is a view schematically illustrating the cleaning system in accordance with the embodiment of the present disclosure.

Referring to FIGS. 5 to 6, a second inlet hole 148 and an outside air introducing passage 200 configured to introduce outside air are provided at the maintenance station 20 to cool the heat generated from the fan motor 41*a* of the draft apparatus 41 that is installed at the maintenance station 20.

The maintenance station 20 includes a first inlet hole 145 configured to intake the dirt at an inside the first dirt container 14 of the robot cleaner 10, the second dirt container 44 configured to store the dirt taken in through the first inlet hole 145, the draft apparatus 41 configured to generate air flow, a filter 47 configured to filter foreign substance from the air discharged from the draft apparatus 41, a first outlet hole 146 configured to discharge air to an inside of the first dirt container 14, and a first outlet passage 103 at where the air discharged from the first outlet hole 146 to flow. The draft apparatus 41 may be provided with the draft fan 41*b* and the fan motor 41*a* included therein.

Here, the first inlet hole 145 may be provided with the second opening unit 22*a* and the inlet port 45' formed at the platform 22 of the maintenance station 20 included therein, and the first outlet hole 146 may be provided with first outlet port 46*a*' and the second outlet port 46*b*' included therein.

According to such structure, a circulating passage 100 is formed between the first inlet hole 145 and the first outlet hole 146, and the circulating passage 100 is formed by the air circulating or circumfluent between the maintenance station 20 and the robot cleaner 10.

The circulating passage 100 may be provided with an inlet passage 102 formed between the first inlet hole 145 and the second dirt container 44, a connecting passage 101 formed between the second dirt container 44 and the draft apparatus 41, and the first outlet passage 103 configured to connect the draft apparatus 41 and the first outlet hole 146 included therein.

The second inlet hole 148 and a second outlet hole 149 that are configured to intake or discharge the outside air to/from an inside the maintenance station 20, respectively, may be provided in a predetermined number, for example, at least one. However, this embodiment is described in relation that the maintenance station 20 includes a single second inlet hole 148 and a single second outlet hole 149.

The outside air introducing passage 200 configured to guide the air introduced from the second inlet hole 148 is provided between the second inlet hole 148 and the circulating passage 100.

The outside air introducing passage 200 is configured to be connected to the connecting passage 101 of the circulating passage 100.

Thus, the outside air introducing passage 200 may be able to decrease the inside temperature of the circulating passage 100 by introducing the outside air to the circulating passage 100, and the air having lower temperature may be able to cool the draft apparatus 41, particularly the fan motor 41*a*.

The second inlet hole 148 is desired to be disposed at a front of the draft apparatus 41.

At this time, the introduction of the outside air through the second inlet hole 148 is desired to take place through the draft apparatus 41 of the dirt eliminating apparatus 40.

The second outlet hole 149 is provided with the second outlet passage 104 configured to connect the second outlet hole 149 to the first outlet passage 103 of the circulating passage 100 included therein.

The second outlet passage 104 is configured to discharge some of the air that passed through the filter 47 to an outside the maintenance station 20.

Thus, when the draft apparatus 41 is operated, cold outside air at an outside the maintenance station 20 is introduced to an inside of the maintenance station 20 through the second inlet hole 148 and is joined at the connecting passage 101 of the circulating passage 100 to decrease the inside temperature of the circulating passage 100. The air having lower temperature, by passing through the draft apparatus 41, cools the heat of the fan motor 41*a*.

Some of the air that cooled the draft apparatus 41, after passing through the filter 47, is discharged to an outside the maintenance station 20 through the second outlet passage 104 and the second outlet hole 149, and the remaining of the air is discharged to the first dirt container 14 of the robot cleaner 10 through the first outlet passage 103 of the circulating passage 100.

In addition, in order to cool the fan motor 41*a* of the maintenance station 20, a frequency of discharging the dirt of the first dirt container 14 within a certain period of time may be limited or a frequency of discharging the dirt by operating the draft apparatus 41 of the maintenance station 20 within a certain period of time may be limited.

In addition, if the temperature of the circulating air flowing at the circulating passage 100 at the maintenance station 20 exceeds a certain temperature, the operation of the maintenance station 20 may be configured to be limited.

At this time, the operation of the maintenance station 20 is desired to be conducted by using bimetal, etc.

Figure 7:
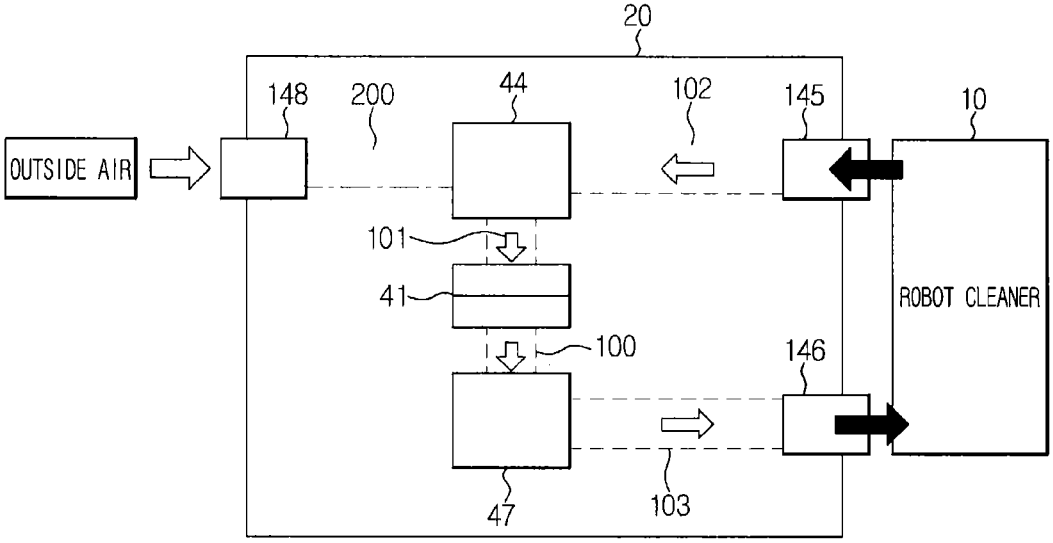
FIG. 7 is a view schematically illustrating a cleaning system in accordance with another embodiment of the present disclosure.

Referring to FIG. 7, the maintenance station 20 is provided with the second inlet hole 148 and the outside air introducing passage 200 configured to introduce outside air to the maintenance station 20, and the first outlet passage 103 and the first outlet hole 146 configured to form the circulating passage 100.

The outside air introducing passage 200 is provided between the second inlet hole 148 and the circulating passage 100 to guide the air introduced from the second inlet hole 148 to the circulating passage 100.

The outside air introducing passage 200 may be configured to be funneled to the connecting passage 101 forming the circulating passage 100, or to be directly connected to the second dirt container 44.

The outside air introduced to an inside the circulating passage 100 through the outside air introducing passage 200 connected to the circulating passage 100 may be able to decrease the inside temperature of the circulating passage 100, and the air having lower temperature, after passing through the draft apparatus 41, may be able to cool the temperature of the fan motor 41*a*.

At this time, the outside air introduced through the second inlet hole 148 is desired to be at about 30% of the entire amount of the air flow.

In addition, the air that cooled the draft apparatus 41, after passing through the filter 47, the first outlet passage 103 on the circulating passage 100, and then the first outlet hole 146, is discharged to the first dirt container 14 of the robot cleaner 10.

Figure 8:
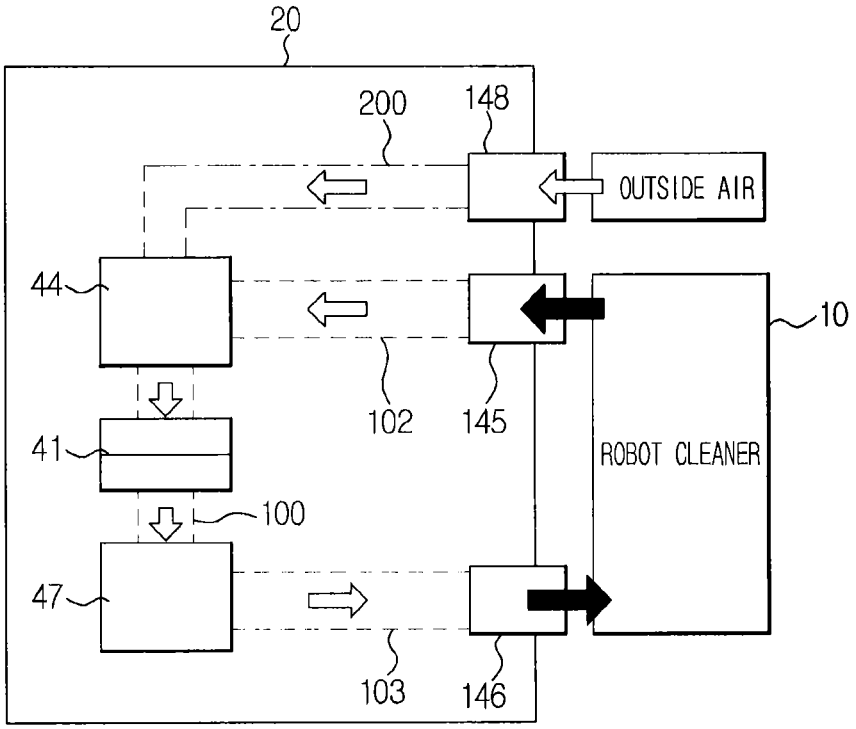
FIGS. 8 to 14 are views schematically illustrating a cleaning system in accordance with another embodiment of the present disclosure.

Referring to FIG. 8, the maintenance station 20 may be provided with the second inlet hole 148 separated from the first inlet hole 145, and at this time, the outside air introducing passage 200 connected to the second inlet hole 148 may be configured to be funneled to the inlet passage 102 of the circulating passage 100 or be directly connected to the second dirt container 44.

Thus, the air joined at the circulating passage 100, before passing through the second dirt container 44, may be able to decrease the inside temperature of the circulating passage 100, and, after cooling the fan motor 41*a* while passing through the draft apparatus 41, may be discharged to the first dirt container 14 of the robot cleaner 10 through the first outlet passage 103 and the first outlet hole 146.

Figure 9:
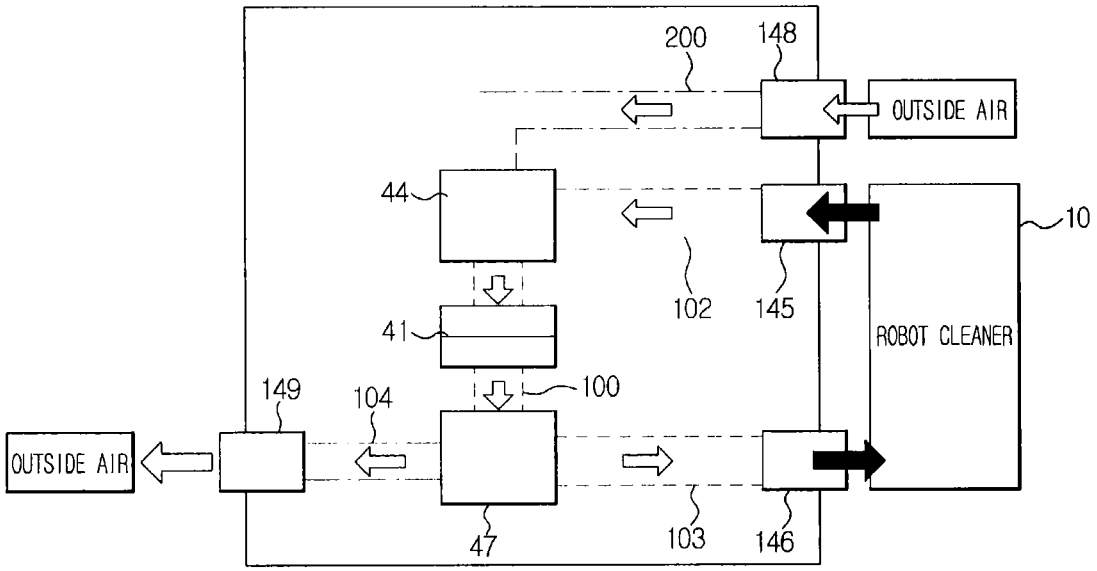

Referring to FIG. 9, in addition, the maintenance station 20 may include the second inlet hole 148 separated from the first inlet hole 145 and, apart from the first outlet hole 146, may include the second outlet passage 104 and the second outlet hole 149 connected to the first outlet passage 103 of the circulating passage 100 included therein.

Thus, as explained above, as the outside air introduced through the second inlet hole 148 is joined at the inlet passage 102 of the circulating passage 100 before passing through the second dirt container 44, the temperature of the air flowing at an inside the circulating passage 100 may be decreased. The cool air having lower temperature, after cooling the fan motor 41*a* while passing through the draft apparatus 41, is discharged to an outside the maintenance station 20 through the second outlet hole 149 and the second outlet passage 104 connected to the circulating passage 100.

The remaining air is discharged to the first dirt container 14 of the robot cleaner 10 through the first outlet passage 103 and the first outlet hole 146 of the circulating passage 100.

Figure 10:
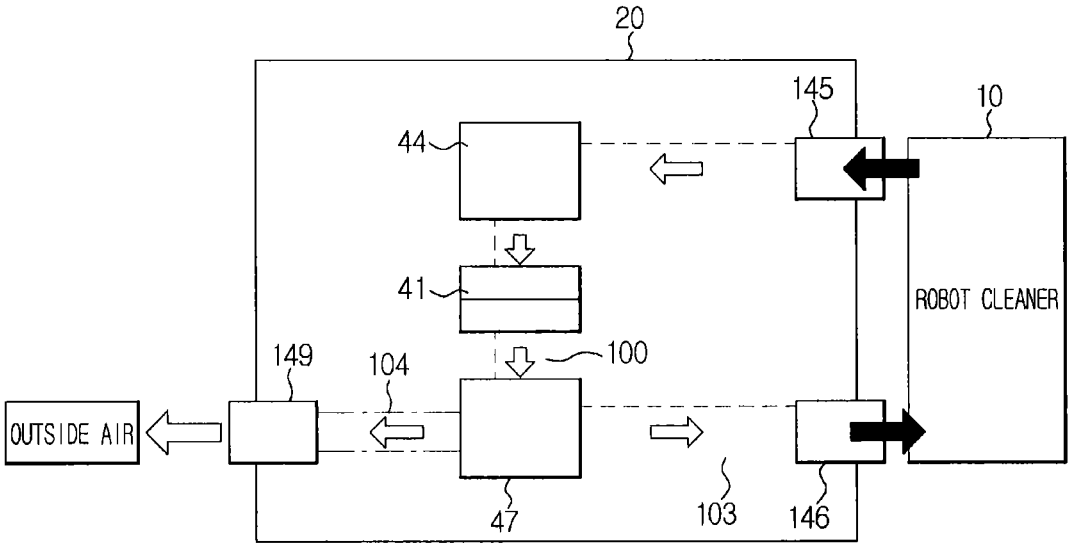

Referring to FIG. 10, the maintenance station 20 is configured not to form a separate structure to introduce outside air to the maintenance station 20, and may only be provided with the second outlet passage 104 and the second outlet hole 149 connected to the first outlet passage 103 of the circulating passage 100.

This is because when some of the air flowing at the circulating passage 100 is discharged to an outside of the maintenance station 20 through the second outlet passage 104 and the outlet hole 149, the outside air at about the same amount of the air discharged is introduced through the first inlet hole 145. That is, in a state that the robot cleaner 10 is docked into the maintenance station 20, outside air may be introduced to an inside the maintenance station 20 through the first inlet hole 145, as a gap is present between the first inlet hole 145 and the robot cleaner 10. In such case, a separate inlet hole to introduce outside air may be omitted.

At this time, the outside air is desired to be at about 30% of the entire amount of the air flow.

The outside air introduced as such decreases the temperature of the air at the circulating passage 100 and is capable of cooling the fan motor 41A as the circulating air having lower temperature passes through the draft apparatus 41.

The air passed through the fan motor 41 a and the filter 47 is discharged to an outside the maintenance station 20 through the second outlet passage 104 and the second outlet hole 149 connected to the circulating passage 100.

The remaining air at the circulating passage 100 is discharged to an inside the first dirt container 14 of the robot cleaner 10 through the first outlet passage 103 and the first outlet hole 146.

Figure 11:
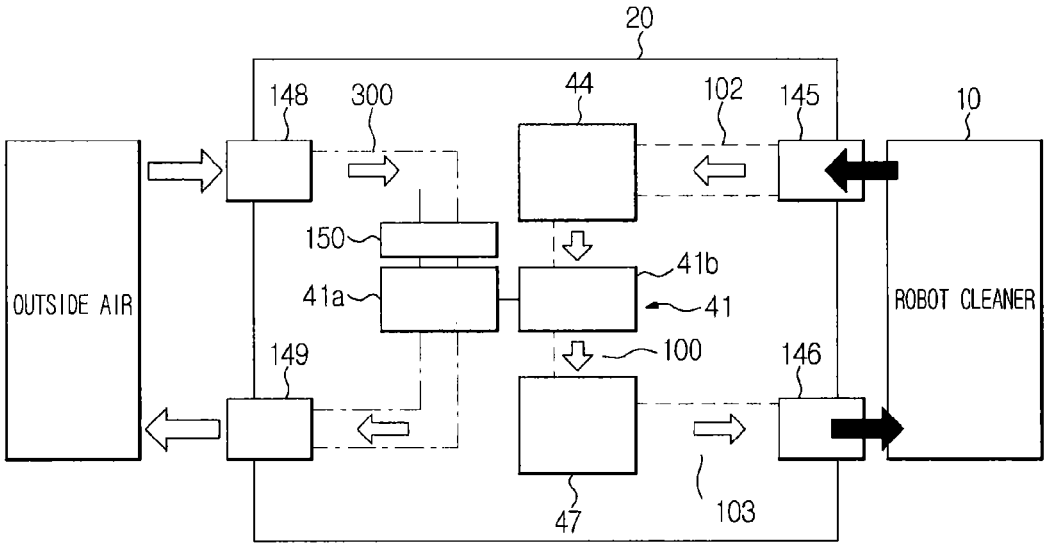

Referring to FIG. 11, the maintenance station 20 is provided with a separate cooling passage 300 which is isolated from the circulating passage 100 configured to intake dirt of the first dir container 14 of the robot cleaner 10 included therein.

The maintenance station 20 may be provided with the first inlet hole 145 configured to intake dirt of the inside the first dirt container 14, the second dirt container 44 configured to store dirt taken in through the first inlet hole 145, the draft apparatus 41 configured to generate air flow, the filter 47 configured to filter foreign substance from the air discharged from the draft apparatus 41, the first outlet hole 146 configured to discharge air to an inside the first dirt container 14 of the robot cleaner 10, and the first outlet passage 103 at where the air discharged by the first outlet hole 146 to flow included therein.

Through such structure, the circulating passage 100 is formed between the first inlet hole 145 and the first outlet hole 146, and the circulating passage 100 is formed by the air circulating or circumfluent between the maintenance station 20 and the robot cleaner 10.

The circulating passage 100 may include the inlet passage 102 formed between the first inlet hole 145 and the second dirt container 44, the connecting passage 101 formed between the second dirt container 44 and the draft apparatus 41, and the first outlet passage 103 configured to connect the draft apparatus 41 and the first outlet hole 146.

The cooling passage 300 of the maintenance station 20 is separately provided from the circulating passage 100, and is provided to cool the fan motor 41*a* of the draft apparatus 41.

The circulating passage 100 and the cooling passage 300 are desired to be disposed in an isolated manner to each other.

The cooling passage 300 includes the second inlet hole 148 configured to introduce outside air to an inside the maintenance station 20 and the second outlet hole 149 configured to discharge air to an outside the maintenance station 20.

The cooling passage 300 is desired to be formed between the second inlet hole 148 and the second outlet hole 149.

A cooling purpose draft fan 150 configured to cool the fan motor 41*a* may be provided at an inside the cooling passage 300.

At this time, the fan motor 41*a* is disposed at an inside the cooling passage 300.

Thus, when the cooling purpose draft fan 150 is operated, outside air at an outside the maintenance station 20 is introduced to the cooling passage 300 through the second inlet hole 148, and the air introduced is discharged to an outside the maintenance station 20 after passing through the draft fan 150 and the fan motor 41*a* through the cooling passage 300, and then through the second outlet hole 149.

Figure 12:
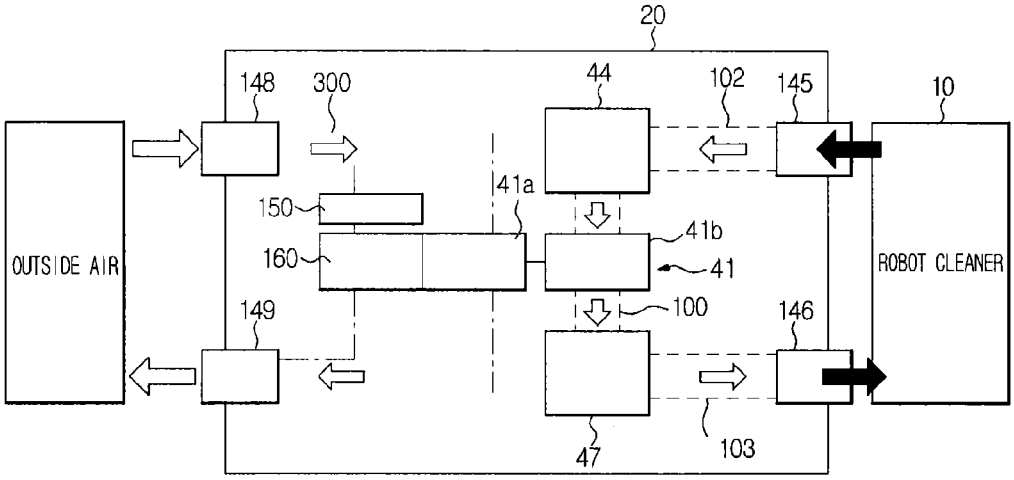

Referring to FIG. 12, a radiator 160 may be disposed at the cooling passage 300 of the maintenance station 20.

The radiator 160 is an apparatus configured to cool heat, and for example, may include a radiator having a plurality of fins, etc. The heat generated from the fan motor 41*a* is cooled by being delivered to the radiator 160, thereby able to cool the fan motor 41*a*.

The radiator 160 is desired to be disposed at an inside the cooling passage 300.

In addition, the cooling passage 300 and the circulating passage 100 are disposed in an isolated manner to each other.

The cooling passage 300 is disposed between the second inlet hole 148 and the second outlet hole 149, and the cooling passage 300 may be provided with the radiator 160 and the cooling purpose draft fan 150 which is configured to generate the flow of the air passing through the radiator 160 installed therein.

Thus, the dirt and air of the first dirt container 14 of the robot cleaner 10 introduced to an inside the maintenance station 20 through the first inlet hole 145 are discharged to the first dirt container 14 of the robot cleaner 10 through the inlet passage 102 of the circulating passage 100, the second dirt container 44, the draft fan 41*b* of the draft apparatus 41, the filter 47 and the first outlet passage 103, and the first outlet hole 146.

Apart from such, the outside air introduced to an inside the maintenance station 20 through the second inlet hole 148 is discharged to an outside the maintenance station 20 by passing through the radiator 160 and the cooling purpose draft fan 150 through the cooling passage 300 connected to the second inlet hole 148, and through the second outlet passage 104 and the second outlet hole 149.

At this time, the radiator 160 is disposed in a way to receive the heat generated from the fan motor 41*a*, and is capable of cooling the fan motor 41*a*.

Figure 13:
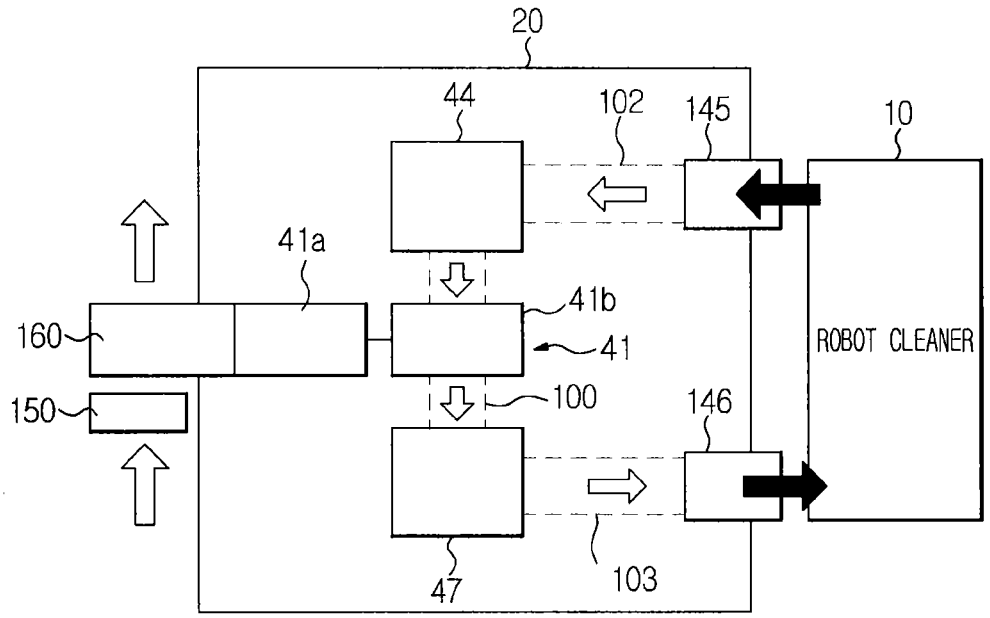
Figure 14:
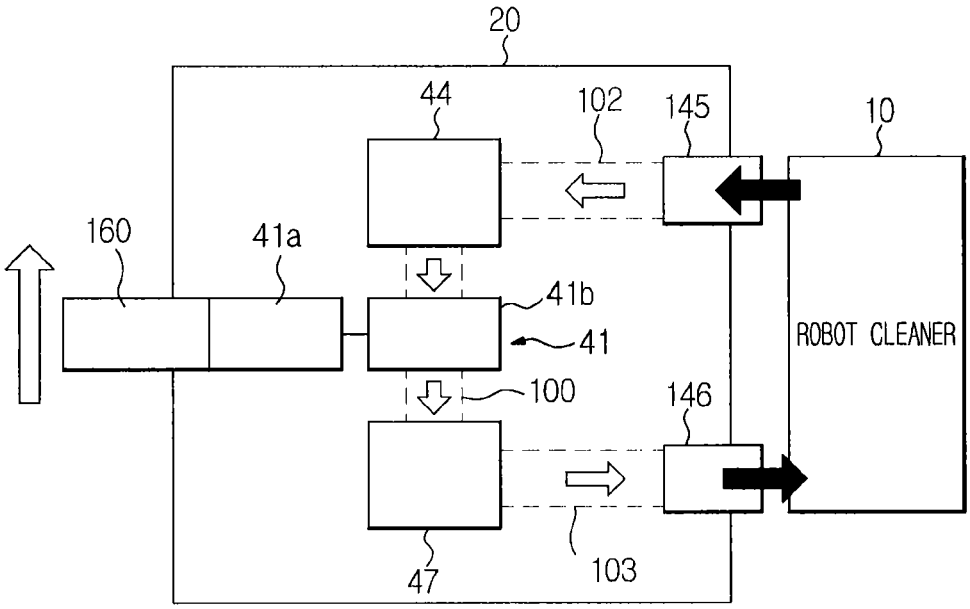

Referring to FIGS. 13 to 14, at least some portion of the radiator 160 may be disposed at an outside the maintenance station 20.

In addition, the cooling purpose draft fan 150 is installed at the radiator 160 disposed at an outside the maintenance station 20 to generate the flow of the air passing through the radiator 160 so that a forced convection is generated.

Thus, the dirt and air introduced through the first inlet hole 145 are capable of cooling the fan motor 41*a* by receiving heat from the fan motor 41*a*, which is configured to operate the draft fan 41*b* of the draft apparatus 41, while passing through the inlet passage 102 of the circulating passage 100 and the second dirt container 44, and then through the cooling purpose draft fan 150 and the radiator 160.

The air passed through the draft fan 41*b* is discharged to the first dirt container 14 of the robot cleaner 10 through the first outlet passage 103 and the first outlet hole 146 of the circulating passage 100.

Figure 15:
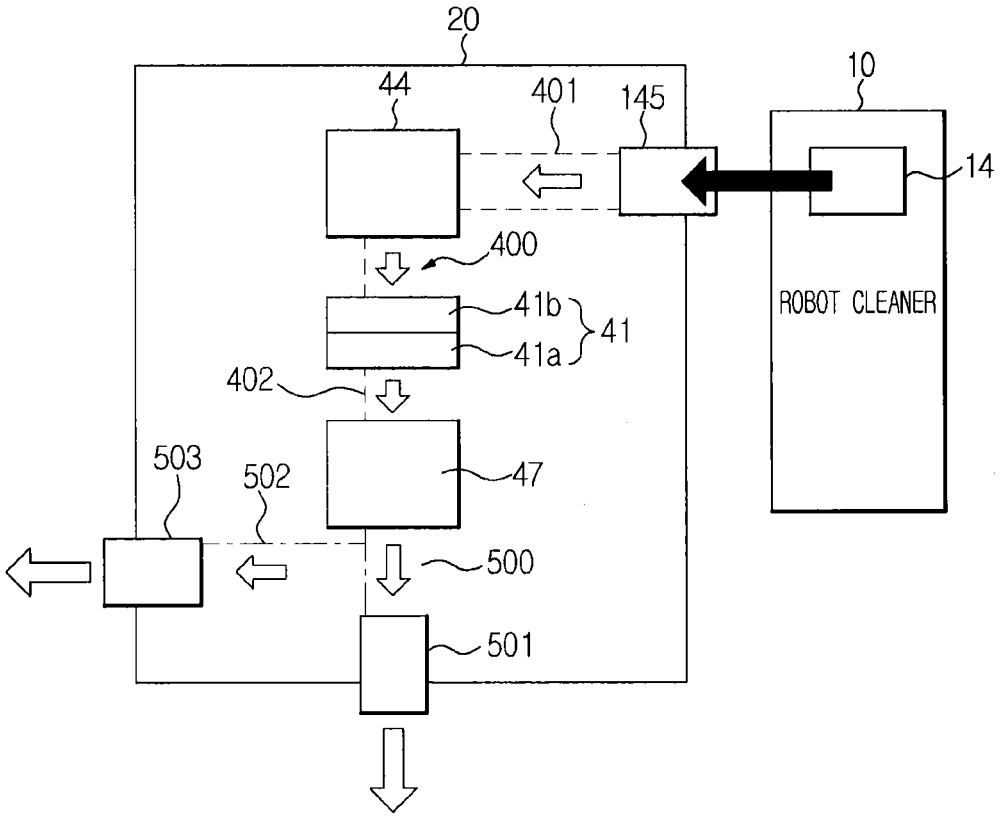
FIG. 15 is a view illustrating a cleaning system having a maintenance station in accordance with another embodiment of the present disclosure.

Referring to FIG. 15, the maintenance station 20 is provided with the first inlet hole 145 configured to intake the dirt at an inside the first dirt container 14 of the robot cleaner 10, the second dirt container 44 configured to store the dirt taken in through the first inlet hole 145, and the draft apparatus 41 configured to generate air flow included therein. The draft apparatus 41 is provided with the draft fan 41*b* and the fan motor 41*a* included therein, and is configured to flow the air through an air passage 400.

The air passage 400 includes an inlet passage 401 connected to the first inlet hole 145, a connecting passage 402 configured to connect the second dirt container 44 and the draft apparatus 41, and a first outlet passage 500 configured to connect the first outlet hole 501. The air taken in through the first inlet hole 145 and guided through the air passage 400 is discharged to an outside the maintenance station 20 through the first outlet hole 501.

The maintenance station 20 is provided with a second outlet hole 503 separately formed from the first outlet hole 501 in order to discharge air through a different route of the first outlet hole 501. As some of the air passing through the first outlet passage 500 is discharged to an outside through the second outlet hole 503, the air flow at an inside the maintenance station 20 becomes much smoother, and thus, the temperature increase of the air by the fan motor 41A is restrained.

The second outlet hole 503 may be connected to the first outlet passage 500 through the second outlet passage 502. The filter 47 is disposed at the first outlet passage 500 to filter foreign substance in the air, and the second outlet passage 502 may be connected to the first outlet passage 500 at the lower flow side of the filter 47.

The second outlet passage 503 is provided to be open/closed and thereby the air flow to the second outlet hole 503 may be controlled as needed. A separate draft fan (now shown) is disposed at the second outlet passage 502, thereby able to improve air cooling effect.

Meanwhile, the first outlet hole 501 may be disposed to be capable of blowing air into an inside the first dirt container 14 of the robot cleaner 10.

Although a few embodiments of the present invention have been shown and described, it would be appreciated by those skilled in the art that changes may be made in these embodiments without departing from the principles and spirit of the invention, the scope of which is defined in the claims and their equivalents.

What is claimed is:

1. A cleaning system comprising:

a robot cleaner having an opening unit and a first dirt container funneled to the opening unit; and a maintenance station to which robot cleaner is docked to discharge dirt stored in the first dirt container, and the maintenance station comprises a first inlet hole configured to intake dirt from the first dirt container through the opening unit;

a first outlet hole configured to blow air into the first dirt container;

a circulating passage provided between the first inlet hole and the first outlet hole;

a second dirt container disposed on the circulation passage to store dirt taken in from the robot cleaner;

a draft apparatus comprising a draft fan and a fan motor to drive the draft fan and allowing air to flow through the circulating passage; and a second outlet hole configured to discharge air inside the circulating passage of the maintenance station to an outside.

2. The cleaning system of claim 1, wherein the circulating passage comprises a first outlet passage connecting the draft apparatus to the first outlet hole, wherein the second outlet hole is connected to the first outlet passage such that some of the air at the first outlet passage is discharged to the outside.

3. The cleaning system of claim 2, wherein the maintenance station further comprises a second outlet passage configured to connect the first outlet passage to the second outlet hole.

4. The cleaning system of claim 1, wherein the first inlet hole is disposed to intake outside air to an inside of the maintenance station even in a state that the robot cleaner is docked to the maintenance station.

5. The cleaning system of claim 1, further comprising a second inlet hole separately disposed from the first inlet hole and configured for outside air to flow into an inside of the maintenance station.

6. A cleaning system comprising:

a robot cleaner having an opening unit and a first dirt container funneled to the opening unit; and a maintenance station to which the robot cleaner is docked to discharge dirt stored in the first dirt container, wherein the maintenance station comprises a first inlet hole configured to intake dirt from the first dirt container through the opening unit;

a first outlet hole configured to blow air into the first dirt container;

a circulating passage provided between the first inlet hole and the first outlet hole;

a second dirt container disposed on the circulation passage to store dirt taken in from the robot cleaner;

a draft apparatus comprising a draft fan and a fan motor to drive the draft fan and allowing air to flow through the circulating passage;

a second inlet hole configured to intake outside air to an inside of the maintenance station; and an outside air introducing passage provided between the second inlet hole and the circulating passage to guide air introduced through the second inlet hole to the circulating passage.

7. The cleaning system of claim 6, wherein the circulating passage comprises a connecting passage configured to connect the second dirt container to the draft apparatus, and the outside air introducing passage is funneled to the connecting passage.

8. The cleaning system of claim 6, wherein the circulating passage comprises an inlet passage provided between the first inlet hole and the second dirt container, and the outside air introducing passage is funneled to the inlet passage.

9. The cleaning system of claim 6, wherein the outside air introducing passage is directly funneled to the second dirt container.

10. The cleaning system of claim 6, wherein the outside air introducing passage is funneled between the fan motor of the inlet passage and the dirt container.

11. The cleaning system of claim 6, wherein the circulating passage comprises a first outlet passage configured to connect the draft apparatus to the first outlet hole, and the maintenance station further comprises a second outlet hole configured to discharge air in the maintenance station to an outside and a second outlet passage configured to connect the first outlet passage to the second outlet hole.

12. The cleaning system of claim 11, wherein the maintenance station further comprises a filter disposed at the first outlet passage to remove dirt from air passed through the draft apparatus, and some of air passed through the filter is discharged to the outside of the maintenance station through the second outlet passage.

13. The cleaning system of claim 6, wherein the fan motor is disposed at an inside of the circulating passage.

14. A maintenance station to which a robot cleaner having a first dirt container is docked, the maintenance station comprising:

a first inlet hole configured to intake dirt from the first dirt container of the robot cleaner;

an air passage connected to the first inlet hole to guide airflow;

a second dirt container disposed on the air passage to store dirt taken in from the robot cleaner;

a draft apparatus comprising a draft motor and a fan motor configured to drive the draft fan and configured for air to flow through air passage;

a first outlet hole configured to discharge air guided through the air passage to an outside of the maintenance station; and a second outlet hole isolated from the first outlet hole to discharge air through a different passage other than through the first outlet hole and configured to be open and closed.

15. The maintenance station of claim 14, wherein the air passage comprises a first outlet passage configured to connect the draft apparatus to the first outlet hole, and the maintenance station further comprises a second outlet passage configured to connect the first outlet passage to the second outlet hole such that some of air passing through the first outlet passage is discharged through the second outlet hole.

16. The maintenance station of claim 14, wherein the first outlet hole is disposed to blow air to an inside of the first dirt container of the robot cleaner.

17. The maintenance station of claim 14, further comprising a second inlet hole provided in an isolated manner with respect to the first inlet hole and formed to introduce outside air to an inside of the maintenance station.

* * * * *